US011285515B2

(12) United States Patent
Sanne

(10) Patent No.: US 11,285,515 B2
(45) Date of Patent: Mar. 29, 2022

(54) ASPIRATION HOPPER ASSEMBLY

(71) Applicant: EBM MANUFACTURING, INC., Norfolk, NE (US)

(72) Inventor: Scott Ronald Sanne, Norfolk, NE (US)

(73) Assignee: EBM Manufacturing, Inc., Norfolk, NE (US)

( * ) Notice: Subject to any disclaimer, the term of this patent is extended or adjusted under 35 U.S.C. 154(b) by 883 days.

(21) Appl. No.: 16/111,760

(22) Filed: Aug. 24, 2018

(65) Prior Publication Data

US 2019/0126320 A1 May 2, 2019

Related U.S. Application Data

(60) Provisional application No. 62/577,200, filed on Oct. 26, 2017.

(51) Int. Cl.
*B07B 4/02* (2006.01)
*B07B 11/06* (2006.01)

(52) U.S. Cl.
CPC ..... *B07B 4/025* (2013.01); *B07B 4/02* (2013.01); *B07B 11/06* (2013.01)

(58) Field of Classification Search
CPC B07B 4/02; B07B 4/025; B07B 11/06; B07B 13/16
See application file for complete search history.

(56) References Cited

U.S. PATENT DOCUMENTS 5,429,248 A * 7/1995 Le Gigan ..... B07B 1/24 209/239
6,435,114 B1 8/2002 Spiesberger
2014/0069781 A1* 3/2014 Finatzer ..... B65G 15/30 198/820
2019/0388939 A1* 12/2019 Bell ..... B07C 5/3422

* cited by examiner

*Primary Examiner* — Michael McCullough
*Assistant Examiner* — Kalyanavenkateshware Kumar
(74) *Attorney, Agent, or Firm* — Zarley Law Firm, P.L.C.

(57) ABSTRACT

An aspiration hopper assembly having a diverter vane, an adjustable depth plate, and a slidable product wave plate disposed within and connected to an aspiration hopper. Below the aspiration hopper is an air tube housing having an air tube with a cut-out section, an air pick-up chamber, and an adjustable velocity plate. Sight windows provide a means for visual inspection to monitor performance when making the adjustments for optimal results. The purpose of the aspiration hopper assembly is to allow good product to pass through the aspiration hopper in order to remove foreign material that is the similar size and lighter in density from good product.

20 Claims, 2 Drawing Sheets

ASPIRATION HOPPER ASSEMBLY

CROSS REFERENCE TO RELATED APPLICATION

This application claims the benefit of U.S. Provisional Application No. 62/577,200 filed Oct. 26, 2017, the contents of this application is hereby incorporated by reference in its entirety.

BACKGROUND OF THE INVENTION

This invention is directed to an aspiration hopper assembly and more particularly to an aspiration hopper assembly where the airflow is adjusted based upon different product characteristics.

Aspiration hoppers are known in the art for removing foreign material known as air liftings from product. One solution for separating air liftings by density has been through the use of air. While useful, the velocity of product flow and air flow are not adjustable and therefore current devices are not adaptable to different product characteristics. Furthermore, current devices do not provide a visual means to adjust product flow and airflow during operation.

An objective of the present invention is to provide an aspiration hopper that is adjustable for different product characteristics.

Another objective of the present invention is to provide an aspiration hopper where product and air flow are adjustable.

A still further objective of the present invention is to provide an aspiration hopper having visual access to the interior.

These and other objectives will be apparent to those having ordinary skill in the art based upon the following written description, drawings and claims.

SUMMARY OF THE INVENTION

An aspiration hopper assembly having an aspiration hopper with a covered top, end walls, angled side walls and an open or closed bottom. Inlet is located on a pre-determined side of the hopper. To disperse product in the hopper a diverter vane, an adjustable product depth plate, and a slidably adjustable product wave plate are disposed within the aspiration hopper. The aspiration hopper has at least one sight window.

Attached to and positioned below the aspiration hopper is an air tube housing. Disposed within the air tube housing and extending through an end wall of the air tube housing is an air tube. The air tube has a cut-out section that angles outwardly from a first to a second end and that is in communication with an air pick-up zone of the air tube housing. Also disposed within the air tube housing is an adjustable velocity plate.

DETAILED DESCRIPTION OF THE PREFERRED EMBODIMENT

Figure 1:
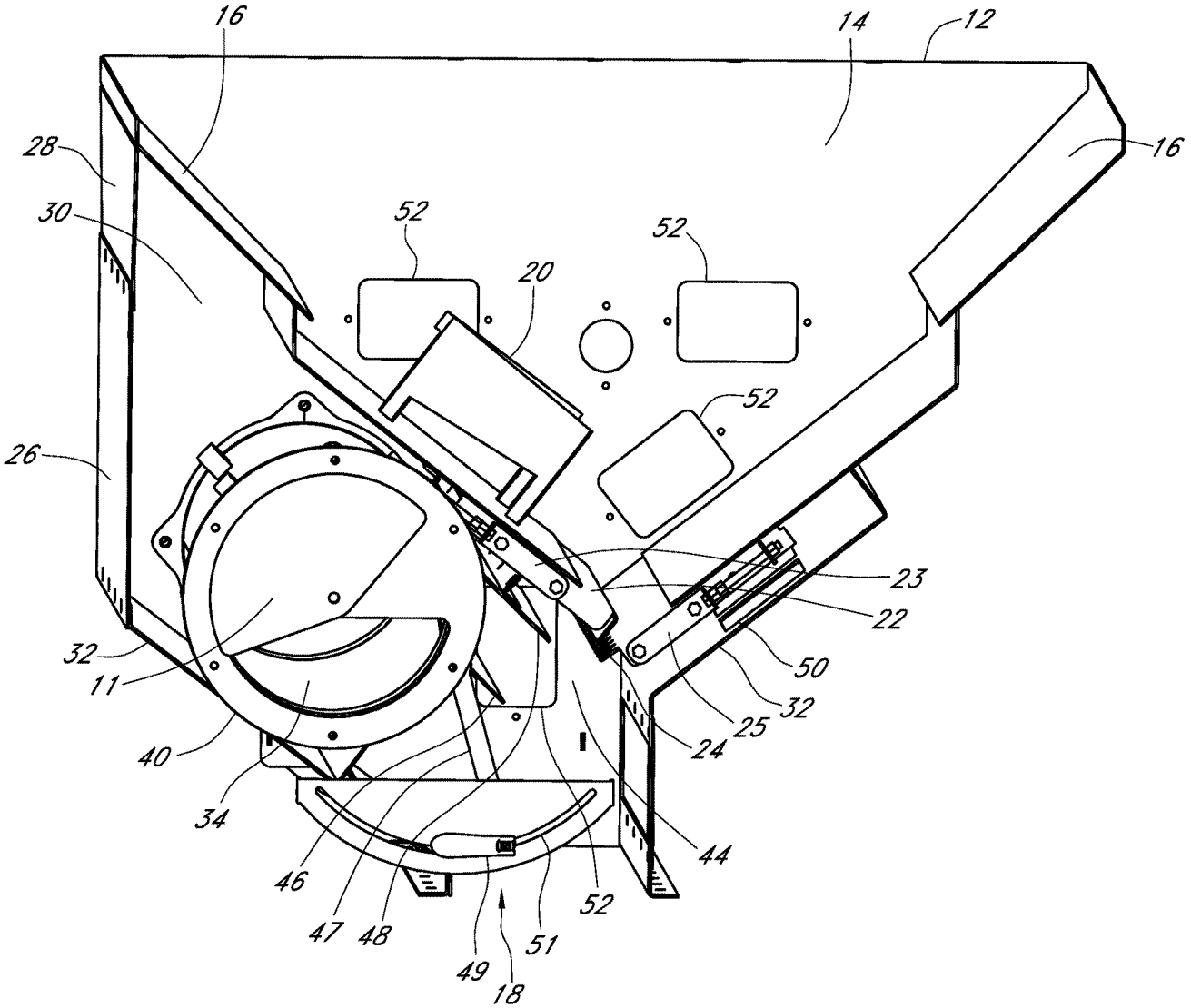
FIG. 1 is an end view of an aspiration housing.
Figure 2:
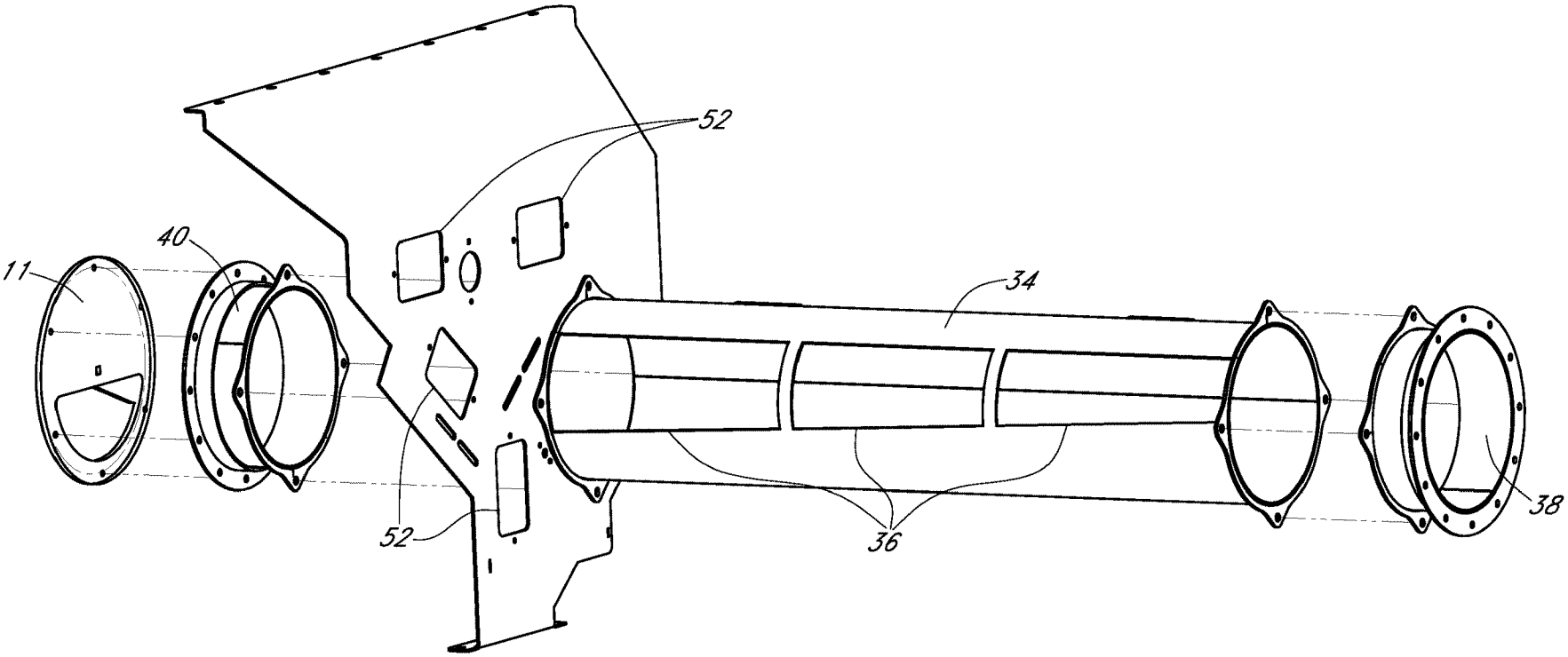
FIG. 2 is an exploded perspective view of an air tube.

Referring to the Figures, an aspiration hopper 10 has a closed top 12, end walls 14, and side walls 16 that are angled inwardly from the top 12 to an open or closed bottom 18.

The angle of the side walls 16 in relation to a horizontal plane is predetermined based upon the product.

Product will enter the aspiration hopper above side wall 16 on the same side as the diverter vane 20. Disposed within the hopper 10 and connected to the side wall 16 is a diverter vane 20. The diverter vane 20 is positioned within the hopper 10 to disperse product across the width of the hopper 10. Attached to the end walls 14 is an adjustable product depth plate 22. The product depth plate 22 is adjusted or moved within a slot 23 based upon the product flowability to further disperse product across the hopper 10 width. By changing the direction of product travel, the rate of product flow is slowed. An adjustable product wave plate 24 slidable within slot 25, preferably made of a corrugated material is attached to the end wall 14 and is positioned for further product displacement.

Attached to and underneath the hopper 10 is an air tube housing 26. The housing 26 has side walls 28, end walls 30, and a bottom wall 32. The top of the housing 26 is covered by the side walls 16 of the hopper 10. Disposed within the housing 26 and extending through an end wall 30 is an air tube 34. The end 38 of the air tube 34 is connected to a bag filter or a cyclone (not shown).

The air tube 34 has a cut-out section 36. The cut-out 36 angles outwardly 2-5 degrees towards the second end 40 and is connected to damper 11. The narrow end of the cut-out is always placed on the end 38 of the air tube 34. The angle of the cut-out 36 is important because if the cut-out was rectangular without the tapered edge, velocity would not be regulated and would be faster closer to the air connection point and would not pull liftings evenly across the width of the hopper.

The air tube 34 engages a side wall 16 of the hopper 10 and the bottom wall 32 of the housing to form an air pick-up zone chamber 44. The air tube 34 is positioned or "clocked" so that the cut-out 36 is in communication with the air pick-up zone 44. The air tube size, including width and diameter is based upon maintaining CFM and velocity requirements. Connected within the air pick-up zone 44 is an adjustable velocity plate 46. The adjustable velocity plate 46 is moved to increase or decrease the air velocity in the air pick-up zone 44. A throat 48 is attached to the air tube 34 and positioned in spaced relation to the adjustable product depth plate 22. Finally, extending through a bottom wall 32 of the housing 26, opposite of air tube 34, is an air inlet 50. The air inlet 50 provides air flow to pass through the product and displacement occurs before product enters the air pick-up zone 44.

In operation, product is deposited into the open top 12 of the hopper 10. As product falls within the hopper 10, the product is divided by the diverter vane 20 and dispersed across the width of the hopper 10. The product next engages the product depth plate 22 which affects the velocity of the falling product. The product then engages the adjustable product wave plate 24 which directs product toward the open bottom 18 of the hopper 10 where the product falls freely into and through the air pick-up zone 44.

As the product falls through the air pick-up zone 44, air is drawn through the air inlet 50, through the air pick-up zone 44, to the air tube 34, and discharged to the bag filter or cyclone (not shown). The air flow passing through the air pick-up zone 44 is calculated to remove lightweight material such as dust, chaff, hulls, and the like. Adjustments to the depth plate 22, the wave plate 24, and the velocity plate 46, and damper 11 are made to provide a specific velocity that accommodates different products. Velocity plate 46 is attached to an adjustment bar 47 having a cam 49 at one end received within an arcuate cam slot 51. Sight windows 52 in end walls 14 provide a means for visual inspection and monitoring adjustments to depth plate 22, wave plate 24 and velocity plate 46 for optimal results. As a result, good product passes through the airflow and discharges through the bottom of the housing 26. Accordingly, an aspiration hopper has been disclosed that removes lightweight density material that is smaller or similar in size from good product.

What is claimed is:

1. An aspiration hopper assembly, comprising:

an aspiration hopper having a top, end walls, angled side walls, and a bottom;

disposed within the aspiration hopper is a diverter vane, a depth plate, and a product wave plate;

wherein the product wave plate is slidably connected to the end walls of the aspiration hopper; and an air tube housing underneath the aspiration hopper.

2. The aspiration hopper assembly of claim 1 wherein the diverter vane is connected to a side wall of the aspiration hopper.

3. The aspiration hopper assembly of claim 1 wherein the depth plate is adjustable within a slot and the depth plate is connected between end walls of the aspiration hopper.

4. The aspiration hopper assembly of claim 1 wherein the product wave plate is made of a corrugated material.

5. The aspiration hopper assembly of claim 1 further comprising an air tube disposed within the air tube housing and extending through an end wall of the air tube housing.

6. The aspiration hopper assembly of claim 5 wherein the air tube has a cut-out section that is angled outwardly as the cut-out section extends from a first end to a second end of the air tube.

7. The aspiration hopper assembly of claim 1 wherein an air inlet extends through a bottom of the air tube housing, so air flow passes through product and displacement occurs before the product enters an air pick-up zone.

8. The aspiration hopper assembly of claim 1 wherein a size of an air tube is based upon maintaining CFM and velocity requirements.

9. The aspiration hopper assembly of claim 8 wherein a velocity plate is attached to an adjustment bar having a cam at one end received within an arcuate cam slot in the air tube housing.

10. The aspiration hopper assembly of claim 1 wherein the air tube housing has an air pick- up zone formed in part by an air tube having a cut-out section in communication with the air pick- up chamber.

11. The aspiration hopper assembly of claim 1 wherein the air tube housing has an adjustable velocity plate.

12. The aspiration hopper assembly of claim 1 wherein the aspiration hopper has at least one sight window.

13. An aspiration hopper assembly, comprising:

an aspiration hopper having end walls, angled side walls, and a bottom;

disposed within the aspiration hopper is a diverter vane, a depth plate, and a product wave plate; and an air tube disposed within an air tube housing and extending through an end wall of the air tube housing, wherein the air tube has a cut-out section that is angled outwardly as the cut-out section extends from a first end to a second end of the air tube.

14. An aspiration hopper assembly, comprising:

an aspiration hopper having end walls, angled side walls, and a bottom;

disposed within the aspiration hopper is a diverter vane, a depth plate, and a product wave plate;

an air tube housing underneath the aspiration hopper, wherein a size of an air tube is based upon maintaining CFM and velocity requirements; and a velocity plate is attached to an adjustment bar having a cam at one end received within an arcuate cam slot in the air tube housing.

15. An aspiration hopper assembly, comprising:

an aspiration hopper having a top, end walls, angled side walls, and a bottom;

disposed within the aspiration hopper is a diverter vane, a depth plate, and a product wave plate;

wherein the depth plate is adjustable within a slot and the depth plate is connected between end walls of the aspiration hopper; and an air tube housing underneath the aspiration hopper.

16. The aspiration hopper assembly of claim 15 wherein the diverter vane is connected to a side wall of the aspiration hopper.

17. The aspiration hopper assembly of claim 15 wherein the product wave plate is slidably connected to the end walls of the aspiration hopper.

18. The aspiration hopper assembly of claim 15 further comprising an air tube disposed within the air tube housing and extending through an end wall of the air tube housing.

19. The aspiration hopper assembly of claim 18 wherein the air tube has a cut-out section that is angled outwardly as the cut-out section extends from a first end to a second end of the air tube.

20. The aspiration hopper assembly of claim 16 wherein the air tube housing has an adjustable velocity plate that is attached to an adjustment bar having a cam at one end received within an arcuate cam slot in the air tube housing.

* * * * *